US008739448B2

(12) United States Patent
Kimmel et al.

(10) Patent No.: US 8,739,448 B2
(45) Date of Patent: Jun. 3, 2014

(54) HANDGUARD SYSTEMS FOR FIREARMS

(75) Inventors: James E. Kimmel, Eagle Point, OR (US); Joseph A. Ivory, Eagle Point, OR (US)

(73) Assignee: Apex Machining Company, Inc., White City, OR (US)

( * ) Notice: Subject to any disclaimer, the term of this patent is extended or adjusted under 35 U.S.C. 154(b) by 494 days.

(21) Appl. No.: 13/007,306

(22) Filed: Jan. 14, 2011

(65) Prior Publication Data

US 2011/0192066 A1 Aug. 11, 2011

Related U.S. Application Data

(60) Provisional application No. 61/294,981, filed on Jan. 14, 2010.

(51) Int. Cl.
*F41C 23/00* (2006.01)

(52) U.S. Cl.
USPC ..... 42/71.01; 42/75.01; 42/72; 42/124; 89/1.42

(58) Field of Classification Search
USPC ..... 42/71.01, 75.01, 124, 72; 89/1.42
See application file for complete search history.

(56) References Cited

U.S. PATENT DOCUMENTS

| | | | |
|---|---|---|---|
| 4,742,636 | A | 5/1988 | Swan |
| D300,161 | S | 3/1989 | Baldus et al. |
| 4,845,871 | A | 7/1989 | Swan |
| 5,142,806 | A | 9/1992 | Swan |
| 5,276,988 | A | 1/1994 | Swan |
| 5,343,650 | A | 9/1994 | Swan |
| 5,533,292 | A | 7/1996 | Swan |
| 6,490,822 | B1 | 12/2002 | Swan |
| 6,499,245 | B1 | 12/2002 | Swan |
| 6,618,976 | B1 | 9/2003 | Swan |
| 6,860,053 | B2 | 3/2005 | Christiansen |
| RE39,465 | E | 1/2007 | Swan |
| 7,204,052 | B2 | 4/2007 | Swan |
| 7,216,451 | B1 | 5/2007 | Troy |
| RE40,216 | E | 4/2008 | Swan |
| 7,356,962 | B2 | 4/2008 | Swan |
| 7,458,179 | B2 | 12/2008 | Swan |
| 7,493,721 | B2 | 2/2009 | Swan |
| D637,684 | S | 5/2011 | Kimmel et al. |
| 2006/0260169 | A1 | 11/2006 | Samson et al. |

OTHER PUBLICATIONS

Memorandum and Order, dated May 5, 2009; issued in Civil Action No. 07-11576-PBS, United States District Court for the District of Massachusetts.

*Primary Examiner* — J. Woodrow Eldred
(74) *Attorney, Agent, or Firm* — Klarquist Sparkman, LLP

(57) ABSTRACT

A hand guard assembly for attachment to a firearm includes an anchor member and a sleeve. The anchor member is coupled to the firearm and defines an inner bore through which a barrel of the firearm extends when the anchor member is coupled to the firearm. The sleeve surrounds a portion of the barrel of the firearm in an overlying relationship. The sleeve is coupled to the anchor member at a first end so that when the assembly is attached to the firearm, the sleeve is cantilevered from the anchor member with an inner surface of the sleeve and an outer surface of the barrel being radially spaced apart from one another.

11 Claims, 8 Drawing Sheets

HANDGUARD SYSTEMS FOR FIREARMS

CROSS REFERENCE TO RELATED APPLICATION

This application claims the benefit of U.S. Provisional Application No. 61/294,981, filed Jan. 14, 2010. The entire disclosure of U.S. Provisional Application No. 61/294,981 is considered to be part of the disclosure of the following application and is hereby incorporated by reference.

FIELD

This disclosure concerns accessories for firearms, and more particularly, but not exclusively, hand guard systems for conventional firearms comprising a barrel, a receiver and a barrel nut configured to couple the barrel to the receiver.

BACKGROUND

Many conventional firearms are configured to be hand-held by a user. For example, many such firearms (e.g., long guns, or firearms with relatively long barrels) provide a first gripping portion in a forward position that is adjacent to or overlies the firearm's barrel and a second gripping portion in a rearward position adjacent the firearm's trigger. The first gripping portion of some conventional firearms comprises a hand guard adjoining the barrel. Such hand guards can be uncomfortable for users, for example, as the barrel temperature increases from repeatedly firing the firearm.

Other hand guards that do not physically touch the barrel have also been proposed. For example, U.S. Pat. No. 5,343,650 discloses an extended rigid frame receiver sleeve having protective spring-loaded hand guards.

Some conventional firearms comprise a receiver and a barrel removably coupled to the receiver. In some firearms, such as, for example, an AR-15 type semi-automatic rifle, a barrel nut couples the barrel to the receiver.

Referring to FIG. 1, a barrel nut and modular hand grip having an upper portion, a lower portion and a coupling assembly are shown, as disclosed in U.S. Pat. No. 7,216,451. A rearward end of the upper portion is configured to engage a top portion of the barrel nut. The coupling assembly is engagable with a bottom portion of the barrel nut and is attached to the rearward end of the upper portion. The upper portion defines spaced lug rails, and the lower portion defines a plurality of spaced lugs that are receivable in the gaps in the lug rails.

AR-15 type firearms comprise separate upper and lower receiver assemblies, which are typically coupled to each other using two through-pins. Such receivers can be quickly interchanged without the aid of tools. Many AR-15 type rifles are also highly configurable and customizable, and are commonly fitted with one or more detachable accessories. Such accessories include a bipod, a foldable or collapsable stock, a threaded barrel configured to attach a flash suppressor, and/or a rail system configured to removably attach still other accessories.

Early rail systems were originally configured to receive a telescopic sight (also referred to herein as a "scope"). Such rail systems became widely adopted, and their use expanded to include other accessories, such as tactical lights, night vision devices, laser sighting modules, reflex sights, fore grips, bipods, and bayonets. Today certain combinations of rails and accessories have even displaced the original sights (so-called "iron sights") of many firearms. Rails have also been proposed for the undersides of frames and even on grips.

In some semi-automatic (and automatic versions) of firearms, and in particular AR-15 type firearms, direct gas impingement provides the necessary forces for re-cocking the firearm (i.e., repositioning the bolt and firing pin assembly to make the firearm ready to fire a second bullet subsequent to firing a first bullet). In such direct gas impingement configurations, expanding gas that pushes a fired bullet through the bore of the barrel flows through a gas port in a distal end of the barrel and into a gas tube typically positioned above and longitudinally aligned with the barrel, as shown in FIG. 2. Such a gas tube fluidically couples the gas port and a gas chamber (sometimes referred to as a "gas key" or bolt carrier key) in the upper receiver. A bolt and bolt carrier in the upper receiver together form a piston, which is driven in a rearward (i.e., toward the firearm's stock) direction by the pressure of such a flow of gas. Such rearward movement by the bolt carrier causes the spent cartridge to be extracted from the firing chamber and ejected through an ejection port in the upper receiver. The bolt and bolt carrier movement also chambers another, unfired, cartridge in the firing chamber and re-cocks the firearm.

Other conventional semiautomatic (and automatic) firearms are also well known. For example, the AK-47 and SIG-556 represent two popular firearms having many similar and derivative designs that are commercially available. As noted above, some conventional firearms have a gas-impingement system configured to chamber an unfired cartridge and re-cock the firearm. Other conventional firearms have a piston system, or other system, configured to chamber an unfired cartridge and re-cock the firearm. Such piston or other systems can have related components (e.g., different than a gas tube) extending longitudinally adjacent to the barrel.

Rapid succession firing can heat the firearm's barrel, making conventional hand guards unsuitable for use during extended periods of such firing. For example, conventional hand guards can increase in temperature and be uncomfortable for a user, and can also restrict airflow around the barrel. In addition, prior hand guards have been difficult to assemble.

SUMMARY

In one embodiment, a hand guard assembly for attachment to a firearm is provided. The assembly includes an anchor member and a sleeve. The anchor member is configured to be coupled to the firearm and defines an inner bore through which a barrel of the firearm can extend when the anchor member is coupled to the firearm. The sleeve is configured to surround a portion of the barrel of the firearm in an overlying relationship. The sleeve is configured to be coupled to the anchor member at a first end so that when the assembly is attached to the firearm, the sleeve is cantilevered from the anchor member with an inner surface of the sleeve and an outer surface of the barrel being radially spaced apart from one another.

In some embodiments, the anchor member can include a first coupler and a second coupler, with the first and second couplers being configured to be fixedly attached to the firearm in opposing alignment. The first coupler and second coupler can collectively define a flange-engaging groove that substantially circumscribes the inner bore of the anchor member. The anchor member can include a longitudinally extending sleeve-receiving region that is configured to extend into the sleeve at the first end.

In other embodiments, the sleeve-receiving region can include a plurality of first openings extending radially through the sleeve-receiving region and the sleeve can include a plurality of second openings extending radially through the sleeve at the first end. The first and second openings can be positioned so that respective first and second openings are aligned with one another to receive respective fasteners therethrough to secure the anchor member to the sleeve.

In some embodiments, the sleeve comprises a central longitudinal axis and, when the assembly is attached to the firearm, the central longitudinal axis of the sleeve is offset from a central longitudinal axis of the barrel of the firearm. The inner bore can comprise a cylindrical barrel receiving region and an intersecting cylindrical operating system region. The sleeve can comprise a plurality of longitudinally extending slots that are spaced apart from one another circumferentially and longitudinally.

In another embodiment, a hand guard assembly is provided. The assembly includes a first coupler, a second coupler, and a longitudinally extending sleeve. The first and second couplers have barrel nut mating portions and sleeve-receiving portions. The longitudinally extending sleeve is configured to surround a portion of a barrel of the firearm in an overlying relationship. The sleeve-receiving portions of the first and second coupler have a plurality of first openings and the sleeve has a plurality of second openings at a first end. The first and second openings are positioned so that respective first and second openings align with one another to receive fasteners therethrough. The first and second couplers are configured to be coupled together so that the barrel nut mating portions of the first and second couplers clamp an exterior surface of a barrel nut of the firearm.

In some embodiments, the sleeve is configured to be cantilevered from the sleeve-receiving portions such that an inner surface of the sleeve and an outer surface of the barrel are radially spaced apart from one another. In other embodiments, the barrel nut mating portions of the first and second couplers collectively define a flange-engaging groove that substantially circumscribes an inner bore defined by the first and second couplers. The sleeve-receiving portions can comprise longitudinally extending portions that extend into the sleeve at the first end.

In other embodiments, the sleeve comprises a central longitudinal axis and, when the assembly is attached to the firearm, the central longitudinal axis of the sleeve is offset from a central longitudinal axis of the barrel of the firearm. The inner bore can also comprise a cylindrical barrel receiving region and an intersecting cylindrical operating system region. In other embodiments, the sleeve comprises a plurality of longitudinally extending slots that are spaced apart from one another circumferentially and longitudinally.

In another embodiment, a method of attaching a hand guard assembly to a firearm is provided. The method comprises positioning a sleeve so that it surrounds a portion of a barrel of the firearm in an overlying relationship, securing an anchor member to the firearm so that a barrel of the firearm extends through an inner bore of the anchor member, and securing a first end of the sleeve to the anchor member so that the sleeve is cantilevered from the anchor member with an inner surface of the sleeve and an outer surface of the barrel being radially spaced apart from one another.

In some embodiments, the anchor member comprises a first coupler and a second coupler, and the act of securing the anchor member to the firearm comprises clamping the first and second couplers to the firearm in opposing alignment. In other embodiments, the first coupler and second coupler collectively define a flange-engaging groove that substantially circumscribes the inner bore of the anchor member and the act of securing the anchor member to the firearm comprises mating the flange-engaging groove with a flange portion of a barrel nut of the firearm. In other embodiments, the anchor member comprises a longitudinally extending sleeve-receiving region and the act of securing the first end of the sleeve to the anchor member comprises positioning the longitudinally extending sleeve-receiving region inside the first end of the sleeve and fastening the longitudinally extending sleeve-receiving region to the first end of the sleeve. In yet other embodiments, the sleeve comprises a central longitudinal axis and the first end of the sleeve is secured to the anchor member with the central longitudinal axis of the sleeve being offset from a central longitudinal axis of the barrel of the firearm.

DETAILED DESCRIPTION

The following describes various principles related to firearm hand guard systems with reference to exemplary hand guards.

Referring to FIGS. 3-9, examples of hand guard systems compatible with conventional firearms will be described with reference to a hand guard assembly 10 configured for an AR-15 type rifle. Although described with reference to an AR-15 type rifle, the principles disclosed herein are applicable to hand guards configured for other conventional firearms, such as, for example, a SIG 556 type firearm, or an AK-47 type firearm. Disclosed hand guard assemblies generally comprise a sleeve 20 and a two-piece anchor portion 30 configured to be removably attachable to a fixed structure of a firearm without directly engaging or otherwise contacting the barrel of the firearm.

Figure 3:
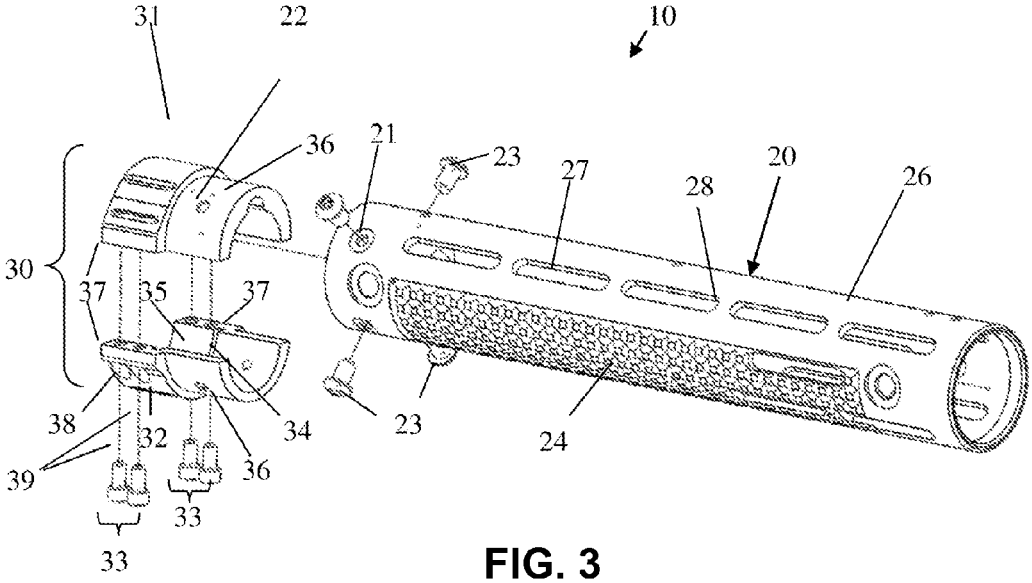
FIG. 3 shows an exploded isometric view of one embodiment of a hand guard assembly as disclosed herein.
Figure 4:
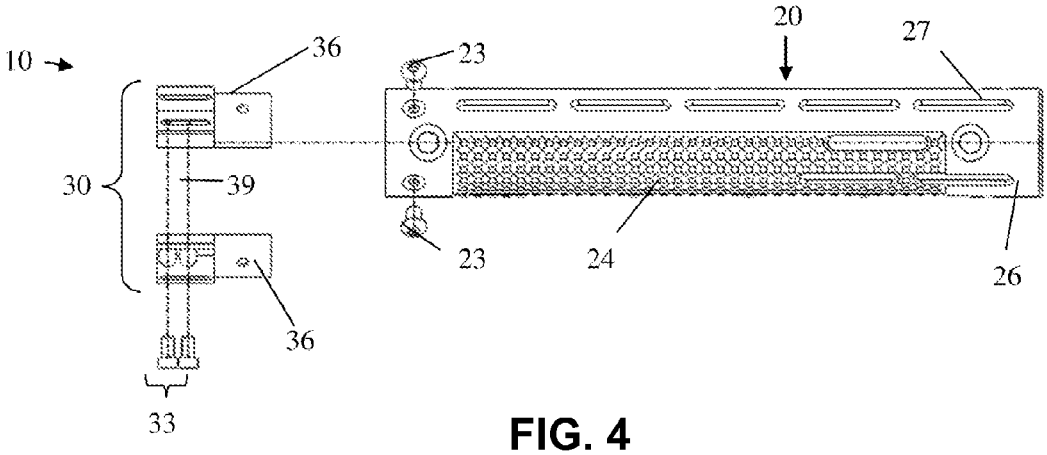
FIG. 4 shows an exploded side elevation view of the hand guard assembly shown in FIG. 3.
Figure 5:
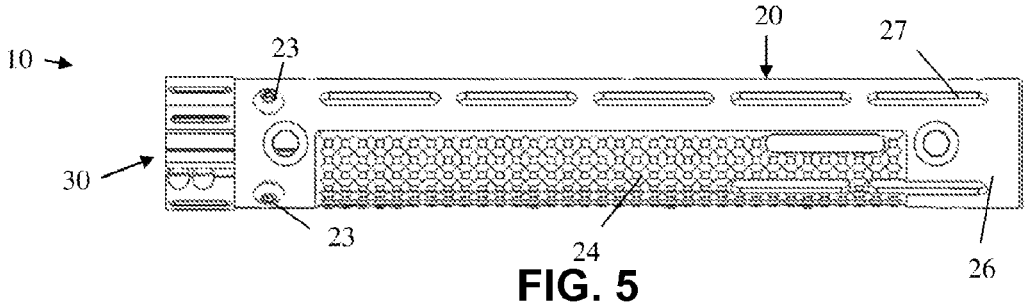
FIG. 5 shows a side elevation view of the hand guard assembly shown in FIG. 3.
Figure 6:
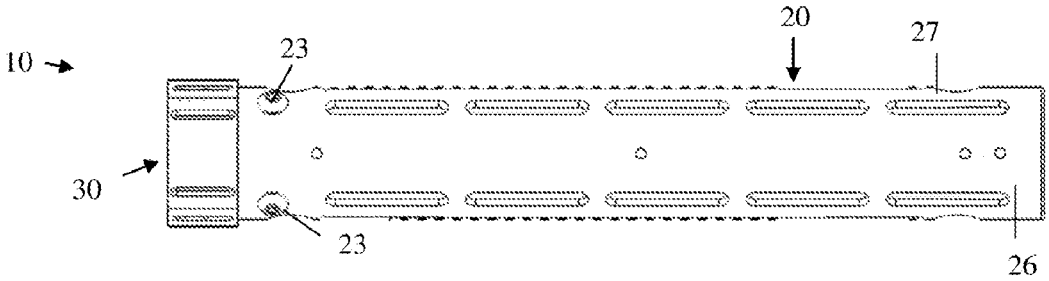
FIG. 6 shows a top plan view of the hand guard assembly shown in FIG. 3.
Figure 7:
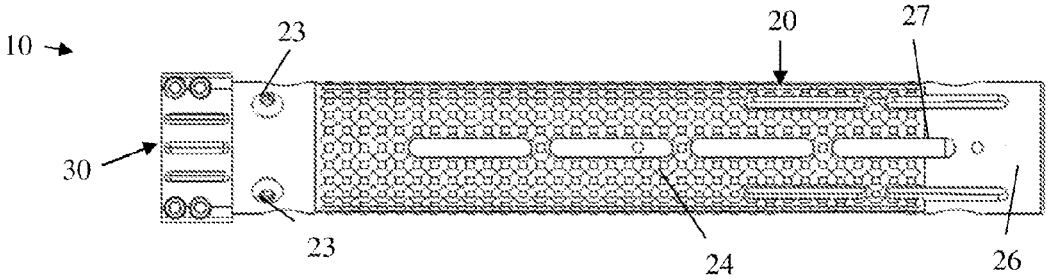
FIG. 7 shows a bottom plan view of the hand guard assembly shown in FIG. 3.

For example and with reference to FIGS. 3 and 4, the illustrated anchor portion 30 comprises an upper coupler 31 and an opposing lower coupler 32 configured to be secured to each other in opposing alignment with threaded fasteners 33.

Figure 1:
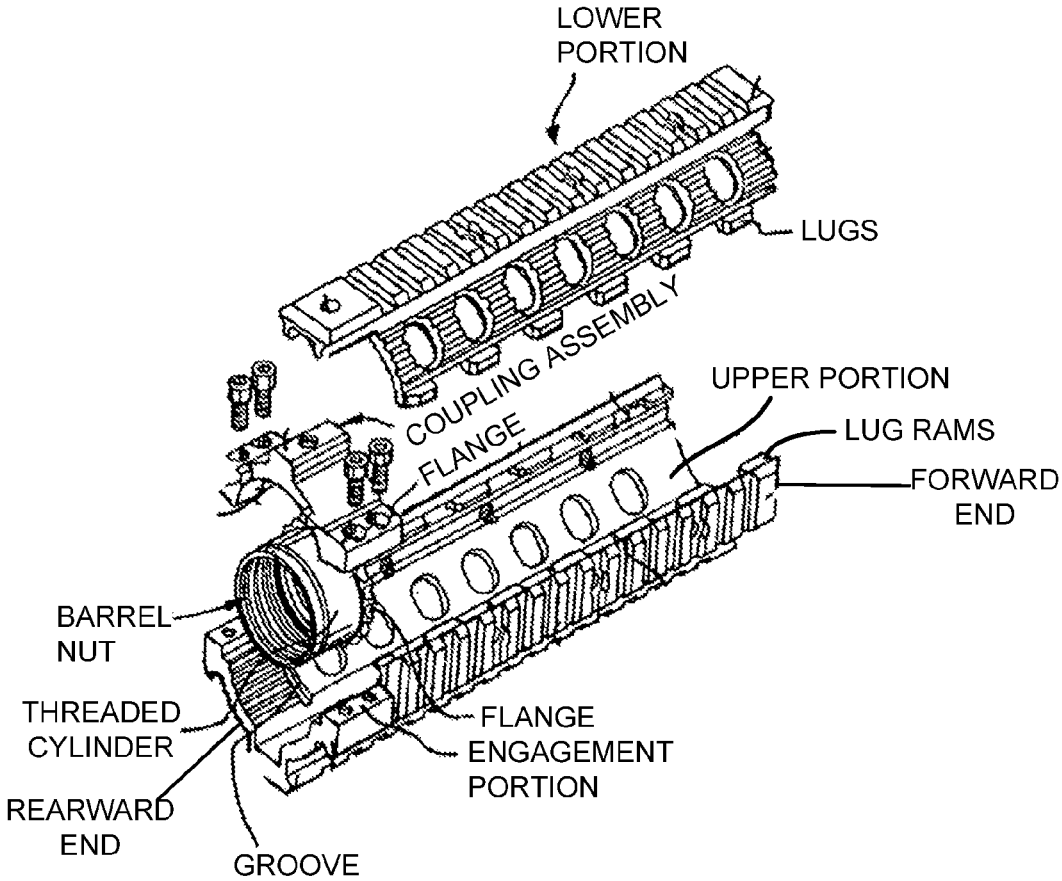
FIG. 1 shows a prior art modular hand grip and barrel nut.
Figure 2:
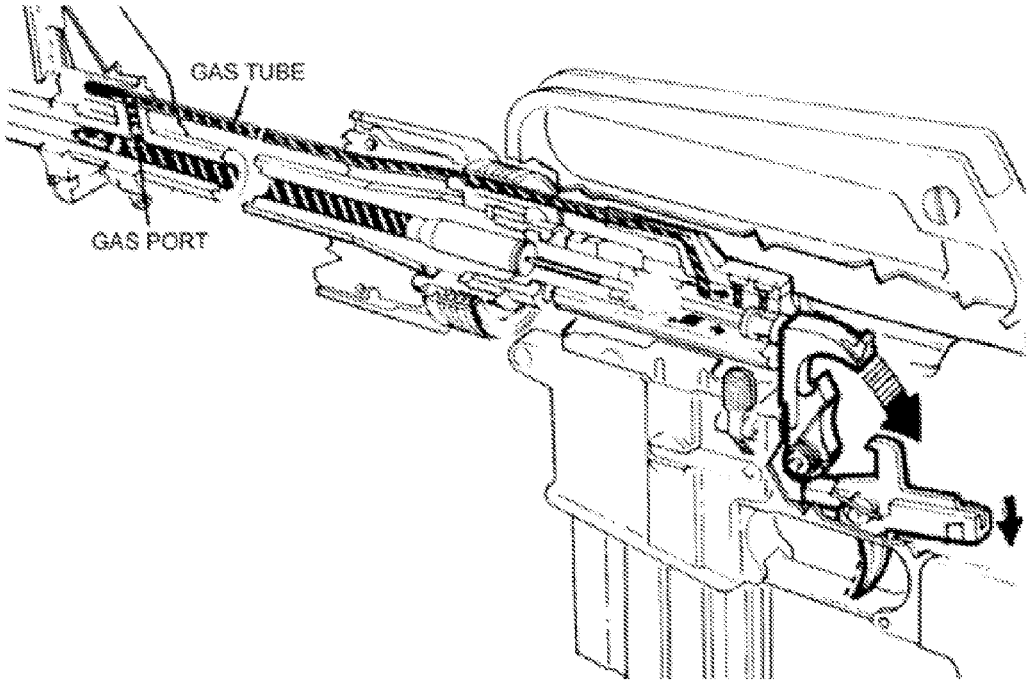
FIG. 2 shows a prior art firearm having a gas tube positioned in longitudinal alignment with the firearm's barrel.

The two-piece anchor portion 30 can be fixedly attached, or clamped, to the barrel nut (shown in FIG. 1) of a firearm in opposing alignment. For example, as shown in FIG. 3, the lower coupler 32 can define a circumferentially extending groove 34 configured to receive a flange of the barrel nut.

The opposing upper coupler 31 can define a groove (not shown) corresponding to the groove 34 in the lower coupler 32 and being configured to receive an upper portion of the flange of the barrel nut. Together, the grooves in the upper and lower couplers 31, 32 can collectively define a flange-engaging groove (such as a continuous flange-engaging groove) that substantially circumscribes the inner bore 40 (FIG. 8) of the anchor portion 30.

Rearward of the groove, the lower coupler can define a barrel-nut mating surface 35 configured to engage a lower portion of the barrel nut's cylindrically shaped outer surface. The portion of the barrel nut engaged by the lower coupler 32 can extend circumferentially by less than 180 degrees. The upper coupler 31 can also define a mating surface configured to engage an upper portion of the barrel nut's cylindrically shaped outer surface.

When the upper and lower couplers 31, 32 are positioned in opposing alignment and secured together, the couplers can tightly clamp the exterior surface of the barrel nut. Clamping the upper and lower couplers 31, 32 to the barrel nut can provide a stable mounting location for a hand guard without directly engaging or otherwise contacting the barrel. In the illustrated embodiment, the guard assembly 10 only directly contacts the barrel nut (and not the barrel).

The anchor portion 30 can also define a longitudinally extending sleeve receiving region 36 being configured to receive an overlying sleeve 20 in mating engagement, as shown, for example, in FIGS. 5, 6, 7 and 9. The sleeve 20 can cantilever from the anchor portion 30 such that the barrel and the sleeve are coaxially aligned and radially spaced from each other. Stated differently, the hand guard assembly 10 can be configured such that the sleeve 20 extends longitudinally of the firearm's barrel in an overlying relationship without contacting the barrel. A hand guard assembly 10 comprising an anchor portion 30 and a sleeve 20 as just described can provide the hand guard with a secure attachment to the firearm without directly engaging or otherwise contacting the barrel with any portion of the hand guard assembly 10.

As shown in FIGS. 3 and 4, the couplers 31, 32 can be positioned in opposing alignment and secured to each other using a plurality of fasteners 33 (e.g., threaded fasteners). For example, the couplers 31, 32 can each comprise a respective arcuately shaped body extending between opposing ends. Each respective end can comprise a flange 37 defining one or more fastener openings 38.

Each flange 37 of the upper coupler 31 can be positioned in opposing alignment with a corresponding flange 37 of the lower coupler 32. In such opposing alignment, the respective fastener openings 38 of the upper coupler 31 and the lower coupler 32 can be aligned, as indicated by the coextensive fastener and opening axes 39 shown in FIGS. 3 and 4. When the openings 38 are aligned, a fastener 33 can be concentrically aligned with and extend through a fastener opening 38 in the lower coupler and into (and/or through) a corresponding fastener opening 38 in the upper coupler.

In some instances, each fastener opening 38 defines a substantially smooth bore extending through the respective flange 37. The fastener 33 can comprise a bolt having a head and a threaded body extending longitudinally therefrom. The threaded body can extend through the respective substantially smooth bores 38 and receive a correspondingly threaded nut. The nut can be threaded toward a head end of the bolt, and the head and the nut can urge the respective flanges 37 of the upper and lower couplers 31, 32 toward each other (e.g., so as to clamp about the exterior of the barrel nut in compression). In other instances, each of the fastener openings 38 defined in one of the couplers is a substantially smooth bore and each corresponding fastener opening in the other coupler is a threaded bore configured to threadably receive a threaded body of a headed fastener. In such embodiments, the head end of the fastener urges the coupler flange defining the substantially smooth bore(s) toward the coupler flange defining the threaded bore(s). In some instances, such a threaded bore is a threaded through bore, and in other instances, such a threaded bore terminates within the flange (i.e., the bore comprises an opening and a recessed region extending into, but not through, the flange).

Figure 8:
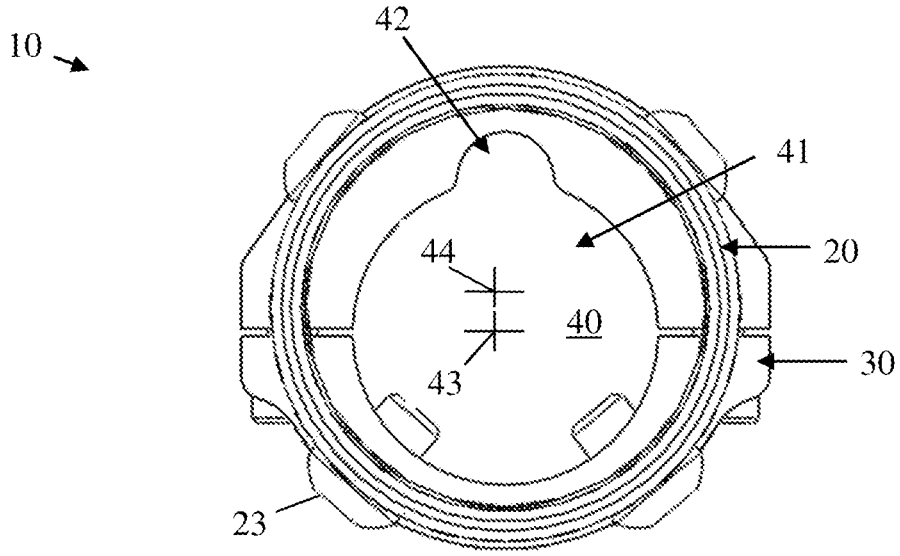
FIG. 8 shows an end elevation view of hand guard assembly shown in FIG. 3.
Figure 9:
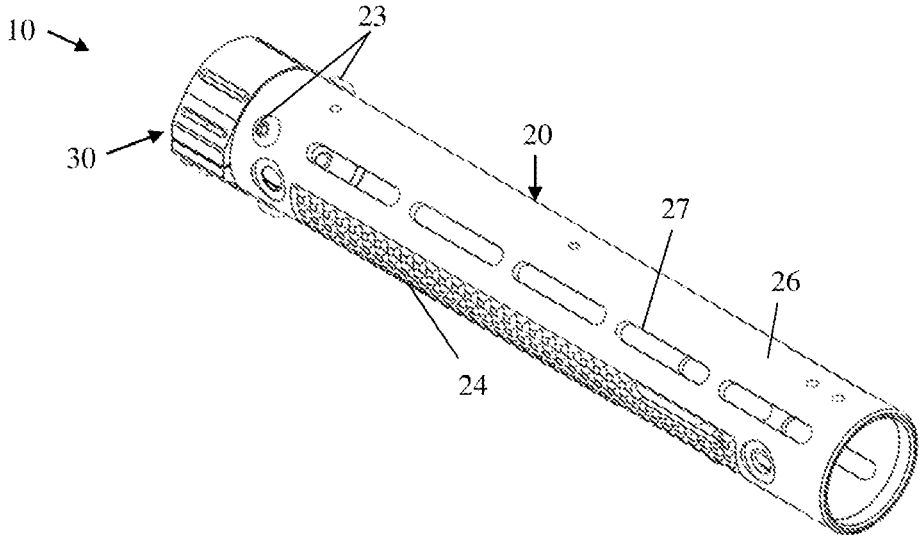
FIG. 9 shows an isometric view of the hand guard assembly shown in FIG. 3.
Figure 10:
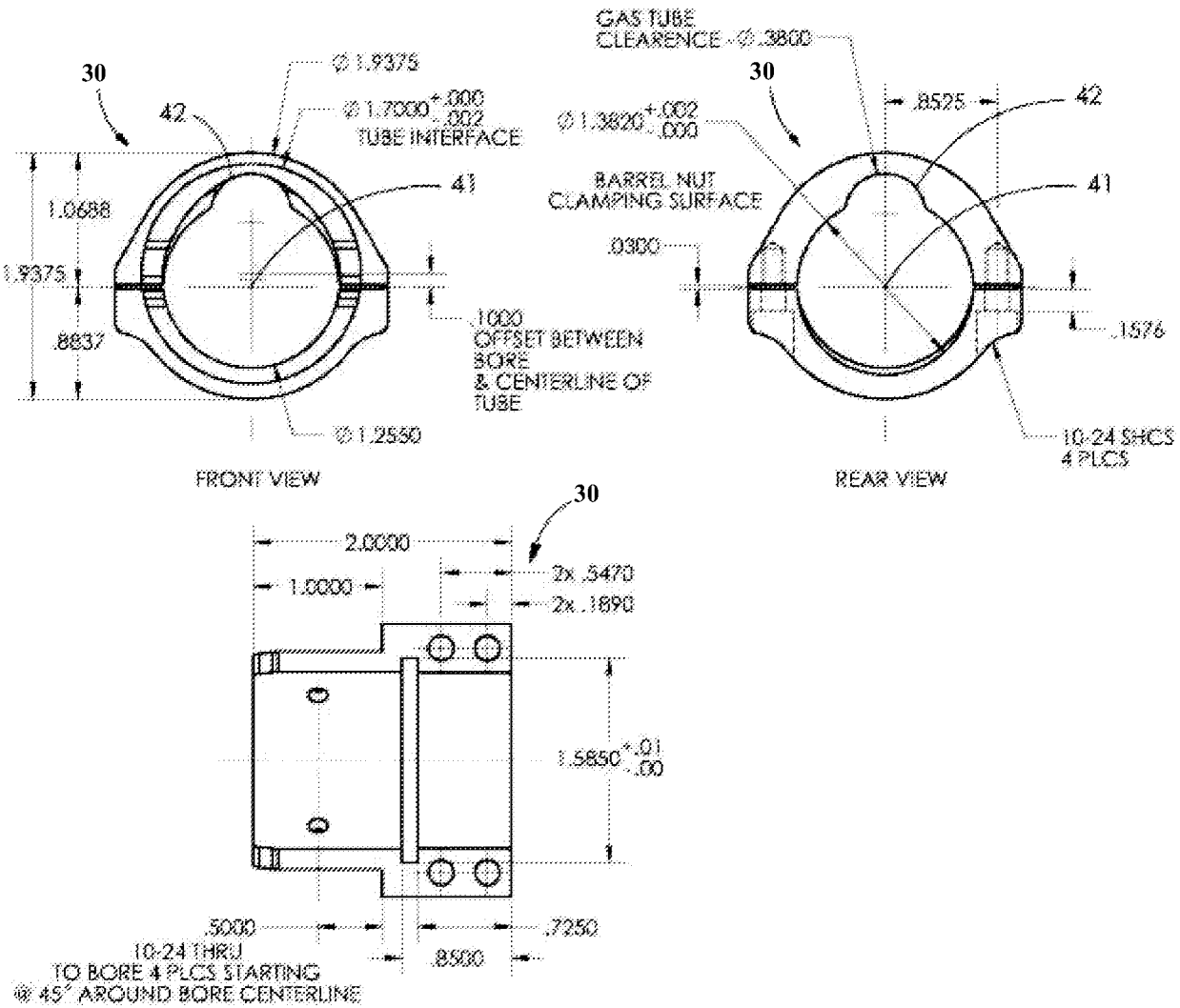
FIG. 10 shows a partial set of engineering drawings of a working embodiment of a hand guard system.
Figure 11:
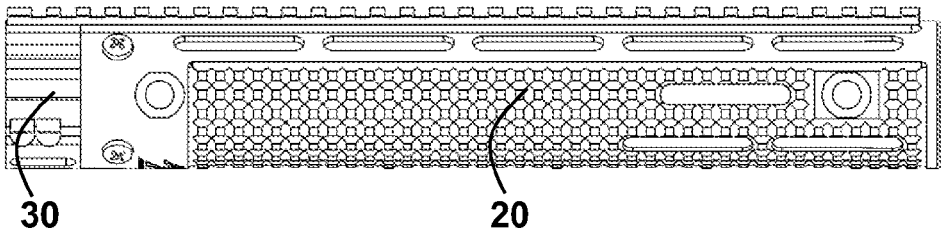
FIG. 11 shows a photograph of a working embodiment of a rifle length hand guard system.
Figure 12:
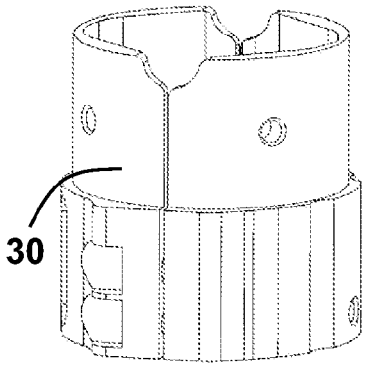
FIG. 12 shows a photograph of a working embodiment of an anchor portion.
Figure 13:
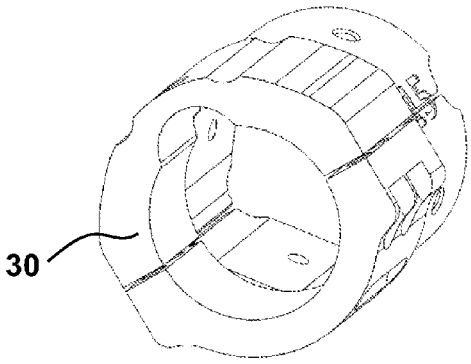
FIG. 13 shows another photograph of the anchor portion shown in FIG. 12.

When the upper coupler 31 and the lower coupler 32 are assembled in opposing alignment, the anchor portion 30 defines an inner bore 40 (for example, as shown in FIG. 8). As shown in FIG. 8, the inner bore can comprise a larger, substantially cylindrical barrel region 41 adjoining, or intersecting, a smaller substantially cylindrical gas-tube, or operating system, region 42.

When installed on a firearm, the firearm's barrel extends through the barrel region 41, and the gas tube, or other operating system component, extends through the gas-tube region 42. In some instances, the respective longitudinal axes of the barrel and the barrel region are substantially coextensive (i.e., the two axes are at the same location, or substantially the same location, in the plane of the page in FIG. 8). Other bore configurations are also possible (e.g., the bore 40 can define a single cylindrically shaped region being so sized as to overly the gas tube and the barrel) in which the barrel axis and the barrel region axis 43 are not coextensive.

As also shown in FIG. 8, the longitudinal axis 43 of the barrel region can be offset from a longitudinal axis 44 of the sleeve 20 and sleeve receiving region 36. Such an asymmetric positioning of the barrel axis 43 and sleeve axis, as shown in FIG. 8, allows the anchor portion 30 to define a smaller overall outer diameter than would be necessary if these axes were coextensive. For example, as compared to a hand guard system having a sleeve concentrically aligned with the barrel, the outer diameter of the sleeve 20 in at least one working embodiment is smaller by about one-eighth of one inch, saving considerable material and weight.

As noted above and shown in FIGS. 5, 6, 7, and 9, the sleeve receiving region 36 can receive a sleeve 20 in an overlying, mating engagement. The sleeve receiving region 36 can define an outer surface having a desired cross-sectional shape (e.g., a polygon, a circle) and dimension(s) (e.g., a diameter). The inner surface of the sleeve 20 can have a mating, or corresponding, cross-sectional shape and dimension such that the sleeve 20 can slidably engage, or overly, the sleeve receiving region 36. Stated differently, at least a portion of the sleeve receiving region 36 can longitudinally extend into an overlying sleeve 20. The sleeve 20 can define a plurality of bores 21 extending radially through the sleeve, and the sleeve receiving region 36 can define a corresponding plurality of radially extending, threaded bores 22 configured to threadably receive respective threaded fasteners 23. When installed, such fasteners 23 can extend through the sleeve 20 and threadably engage the threaded bores 22 such that the sleeve is fixedly attached to the anchor portion 30 and movement (e.g., translation and rotation) is inhibited.

The sleeve 20 can comprise a gripping region 24. For example, a region 24 of the sleeve 20 can be knurled or otherwise roughened to provide a user with an improved grip on the sleeve during firing. A roughened surface configuration can also provide a larger surface area compared to a smooth surface, thereby enhancing heat transfer from the sleeve 20 and improved cooling of the firearm compared to a smooth surface.

Although the illustrated sleeve 20 comprises a substantially cylindrical outer surface 26, alternatively shaped outer surfaces are possible. For example, some sleeves comprise an outer surface having an ovoidal cross-section configured to correspond to the shape of a user's forward hand when positioned for grasping the sleeve during firing.

Some sleeves 20 comprise features configured to receive firearm accessories. For example, the illustrated sleeve 20 defines a plurality of longitudinally extending slots 27. The illustrated slots are spaced from each other circumferentially and longitudinally. Such slots 27 tend to lighten the sleeve and can be arranged relative to each other to provide a continuous, circumferentially extending band of material 28. Such bands 28 between longitudinally adjacent slots 27 can strengthen the sleeve 20 compared to a sleeve having slots extending a majority of the length of the barrel without intermediate bands. The slots 27 can be positioned (or spaced apart) at various circumferential positions, such as, for example, 0, 45, 90, 135, 180, 225, 270 and 315 degrees.

One or more of the slots 27 can provide mounting or attachment points for a rail system (not shown) and/or other firearm accessories (not shown). When left unobstructed, the slots 27 can provide enhanced airflow over the barrel and thereby improve barrel cooling compared to hand guards without such slots.

Although hand guard systems 10 of many lengths are possible, at least four working embodiments have been constructed using an aluminum alloy. The surface of each component of the working embodiments has been coated with a hard anodization coating to improve corrosion resistance of the hand guard system.

An overall length (measured from a rearward end of the anchor portion to a forward end of the sleeve) of a first working, assembled hand guard system was 9.0 inches (sometimes referred to as a "mid-length system"). The "mid-length system" weighs about 11.0 ounces.

An overall length of a second working, assembled hand guard system was 12.5 inches (sometimes referred to as a "rifle-length system"). The "rifle-length system" weighs about 15.1 ounces.

An overall length of a third working, assembled hand guard system was 7.125 inches (sometimes referred to as a "carbine-length system"). The "carbine-length system" weighs about 9.8 ounces.

An overall length of a fourth working, assembled hand guard system was 10.5 inches (sometimes referred to as an "extended carbine-length system"). The "extended carbine-length system" weighs about 10.5 ounces, and defines a notch extending longitudinally rearward from a forward end of the sleeve.

Figure 14:
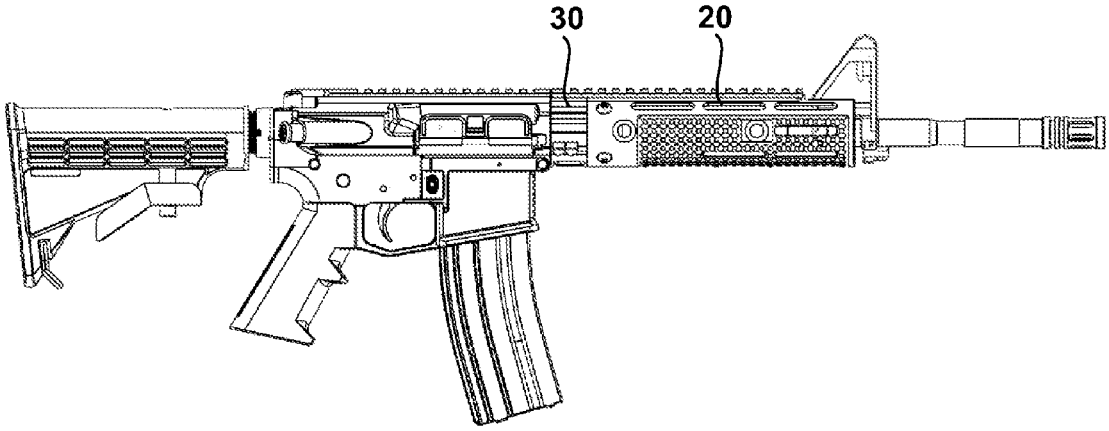
FIG. 14 shows a photograph of a working embodiment of an extended carbine-length hand guard system installed on an AR-15 type firearm.
Figure 15:
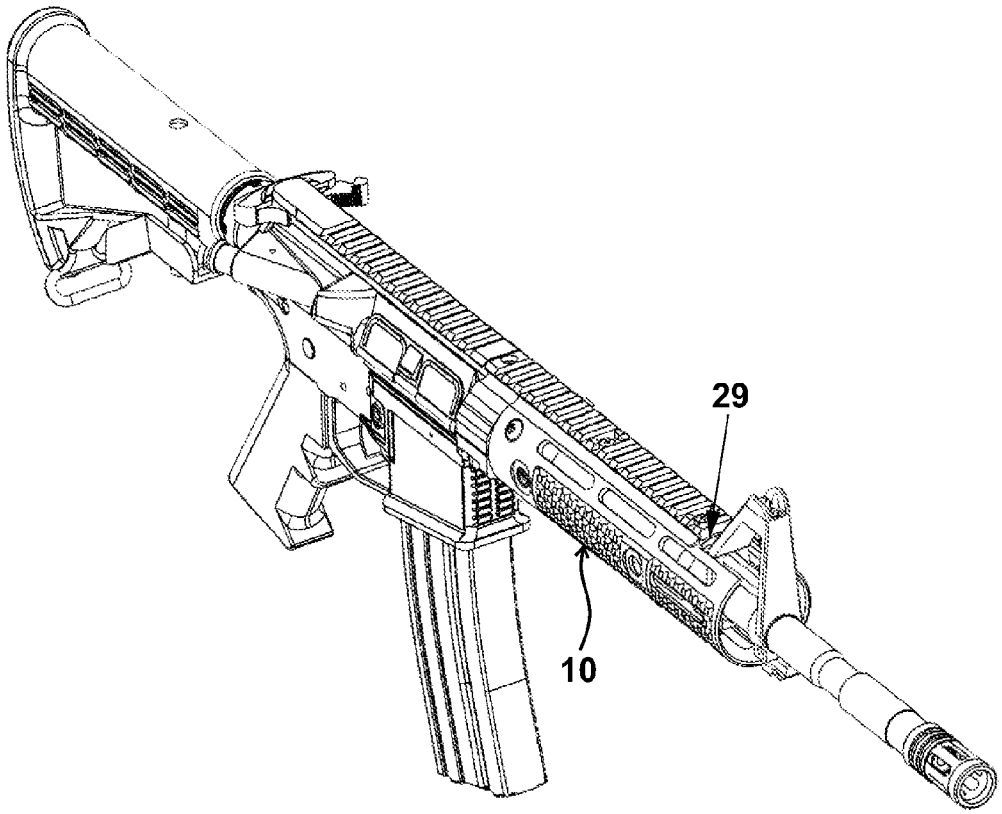
FIG. 15 shows another photograph of the hand guard system shown in FIG. 14.

Such a notch 29 (shown in the photographs in FIGS. 14 and 15) can be incorporated in other (e.g., shorter) sleeves, making the sleeve compatible with a wider range of barrel lengths. For example, the notch can be so dimensioned as to allow a permanent forward sight (e.g., an iron sight) to fit within the notch and prevent interference between the sleeve and the sight (or other firearm feature). Stated differently, the notch can be so sized as to allow at least a portion of the sleeve to extend forward of the rearward-most portion of a permanent sight. Such an extended sleeve provides additional area for a user to grasp as compared to a sleeve extending only as far forward as the rearward-most portion of the sight.

Hand guard systems as described herein can significantly improve the AR-15 platform by providing an easy to use, easy to assemble and reliable hand guard, and by expanding the comfort, versatility, and compatibility of firearm accessories. For example, the disclosed hand guard systems can allow rail sections to be mounted in a desired location while providing a comfortable gripping area in the remaining unobstructed areas.

Other Embodiments

This disclosure makes reference to the accompanying drawings which form a part hereof, wherein like numerals designate like parts throughout. The drawings illustrate specific embodiments, but other embodiments can be formed and structural changes can be made without departing from the intended scope of this disclosure. Directions and references (e.g., up, down, top, bottom, left, right, rearward, forward, etc.) can be used to facilitate discussion of the drawings but are not intended to be limiting. For example, certain terms can be used such as "up," "down," "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" as well as "and" and "or."

Accordingly, this detailed description shall not be construed in a limiting sense, and following a review of this disclosure, those of ordinary skill in the art will appreciate the wide variety of cooling systems that can be devised and constructed using the various concepts described herein. Moreover, those of ordinary skill in the art will appreciate that the exemplary embodiments disclosed herein can be adapted to various configurations without departing from the disclosed concepts. Thus, in view of the many possible embodiments to which the disclosed principles can be applied, it should be recognized that the above-described embodiments are only examples and should not be taken as limiting in scope.

The foregoing and other objects, features, and advantages of the invention will become more apparent from the following detailed description, which proceeds with reference to the accompanying figures.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A hand guard assembly for attachment to a firearm, the assembly comprising;

an anchor member configured to be coupled to the firearm, the anchor member defining an inner bore through which a barrel of the firearm can extend when the anchor member is coupled to the firearm, the anchor member configured to extend completely around the barrel of the firearm; and a sleeve configured to surround a portion of the barrel of the firearm in an overlying relationship, wherein the sleeve is configured to be coupled to the anchor member at a first end portion of the sleeve, the first end portion being configured to extend over and completely around a mating surface of the anchor member in an overlying relationship, and the sleeve and the anchor member being configured such that, when the assembly is attached to the firearm, the sleeve is cantilevered from the anchor member with an inner surface of the sleeve and an outer surface of the barrel being radially spaced apart from one another;

wherein the sleeve comprises a unitary component that extends completely around the barrel.

2. The assembly of claim 1, wherein the anchor member comprises a first coupler and a second coupler, the first and second couplers being configured to be fixedly attached to the firearm in opposing alignment.

3. The assembly of claim 2, wherein the first coupler and second coupler collectively define a groove that substantially circumscribes the inner bore of the anchor member, wherein the groove is configured to receive a flange of a barrel nut.

4. The assembly of claim 2, wherein each of the first and second couplers comprises a longitudinally extending sleeve-receiving portion that is configured to extend into the first end portion of the sleeve.

5. The assembly of claim 4, wherein each sleeve-receiving portion comprises a plurality of first openings extending radially through the sleeve-receiving portion and the sleeve comprises a plurality of second openings extending radially through the first end portion of the sleeve, and the first and second openings are positioned so that respective first and second openings can be aligned with one another to receive respective fasteners therethrough to secure the sleeve to the first and second couplers.

6. The assembly of claim 1, wherein the sleeve comprises a central longitudinal axis and, when the assembly is attached to the firearm, the central longitudinal axis of the sleeve is offset from a central longitudinal axis of the barrel of the firearm.

7. The assembly of claim 1, wherein the inner bore comprises a cylindrical barrel receiving region and an intersecting cylindrical operating system region.

8. The assembly of claim 1, wherein the sleeve comprises a plurality of longitudinally extending slots spaced apart from one another circumferentially and longitudinally.

9. A method of attaching a hand guard assembly to a firearm, the method comprising:

positioning a sleeve so that it surrounds a portion of a barrel of the firearm in an overlying relationship;

securing an anchor member to the firearm so that a barrel of the firearm extends through an inner bore of the anchor member; and securing a first end of the sleeve to the anchor member so that the sleeve is cantilevered from the anchor member with an inner surface of the sleeve and an outer surface of the barrel being radially spaced apart from one another;

wherein the anchor member comprises a first coupler and a second coupler, and the act of securing the anchor member to the firearm comprises clamping the first and second couplers to the firearm in opposing alignment;

wherein the first and second couplers each comprises a longitudinally extending sleeve-receiving portion and the act of securing the first end of the sleeve to the anchor member comprises positioning the longitudinally extending sleeve-receiving portions inside the first end of the sleeve and fastening the longitudinally extending sleeve-receiving portions to the first end of the sleeve.

10. The method of claim 9, wherein the first coupler and second coupler collectively define a groove that substantially circumscribes the inner bore of the anchor member, and the act of securing the anchor member to the firearm comprises mating the groove with a flange portion of a barrel nut of the firearm.

11. The method of claim 9, wherein the sleeve comprises a central longitudinal axis and the first end of the sleeve is secured to the anchor member with the central longitudinal axis of the sleeve being offset from a central longitudinal axis of the barrel of the firearm.

* * * * *